US006582092B1

(12) United States Patent
Marka

(10) Patent No.: US 6,582,092 B1
(45) Date of Patent: Jun. 24, 2003

(54) LAMP FOR FORMING A LOW-SHADOW LIGHTING FIELD

(75) Inventor: Rudolf Marka, Frankfurt (DE)

(73) Assignee: Heraeus Med GmbH, Hanau (DE)

( * ) Notice: Subject to any disclaimer, the term of this patent is extended or adjusted under 35 U.S.C. 154(b) by 0 days.

(21) Appl. No.: 09/382,224

(22) Filed: Aug. 24, 1999

(30) Foreign Application Priority Data

Aug. 26, 1998 (DE) ..... 198 38 627

(51) Int. Cl.[7] ..... F21V 13/06

(52) U.S. Cl. ..... 362/33; 362/804; 362/319; 362/35

(58) Field of Search ..... 362/33, 232, 238, 362/239, 250, 280, 281, 283, 319, 322

(56) References Cited

U.S. PATENT DOCUMENTS

| | | | | |
|---|---|---|---|---|
| 4,316,237 A | | 2/1982 | Yamada et al. | |
| 4,395,750 A | | 7/1983 | Scheidemann et al. | |
| 4,745,526 A | * | 5/1988 | Sestak | 362/35 |
| 4,884,008 A | * | 11/1989 | Bossler | 315/152 |
| 5,068,767 A | * | 11/1991 | Koyama | 362/33 |
| 5,178,452 A | * | 1/1993 | Scholtz | 362/319 |
| 5,383,105 A | | 1/1995 | Agut | |

FOREIGN PATENT DOCUMENTS

| | | |
|---|---|---|
| DE | 117 933 | 2/1901 |
| DE | 673 069 | 3/1939 |
| DE | 25 19 426 A1 | 8/1976 |
| DE | 40 23 408 A1 | 1/1992 |
| EP | 0 299 196 B1 | 1/1989 |
| GB | 6605763 | 8/1970 |
| GB | 1 537 181 | 1/1977 |

* cited by examiner

*Primary Examiner*—Sandra O'Shea
*Assistant Examiner*—Hargobind S. Sawhney
(74) *Attorney, Agent, or Firm*—Akin, Gump, Strauss, Hauer, & Feld, L.L.P.

(57) ABSTRACT

A lamp, in particular a lamp for medical applications (operating lamps), having at least one light source, and at least two reflectors, is provided where in order to form a low-shadow illuminated area, light emerging from the lamp impinges upon the illuminated area by at least two different angles of incidence, such that the angles of incidence of the light can be adjusted by changing the distance between the at least two reflectors or between one reflector and the source of the light. The at least two reflectors may be arranged so that they can shift in the radial direction on carrier rails that extend radially from the center of the lamp. In this arrangement, the reflectors always lie on a common circular circumference, and the reflectors can be shifted through manually activated gears or through electric drive motors.

Two ring-shaped reflectors may also be provided coaxially to the lamp-longitudinal axes, where an outer ring-reflector surrounds the light source affixed along the longitudinal axis, while on the side that faces away from the illuminated area, an inner ring-reflector is provided. The inner ring reflector is arranged so that it can be shifted along the longitudinal axis.

Alternatively, two ring-shaped reflectors are provided coaxially to the lamp-longitudinal axes, where an outer ring-reflector surrounds the light source arranged along the longitudinal axis, while on the side that faces away from the illuminated area, an inner ring-reflector is provided in a fixed position. The light source is arranged so that it can be shifted along the longitudinal axis.

6 Claims, 3 Drawing Sheets

LAMP FOR FORMING A LOW-SHADOW LIGHTING FIELD

BACKGROUND OF THE INVENTION

The invention involves a lamp, in particular a lamp for medical applications, having at least one source for light emission, at least two reflectors, where in order to form a low-shadow illuminated area, light emerging from the lamp impinges upon the illuminated area by at least two different angles of incidence.

From the patent GB-PS 1 537 181, a lighting device—in particular an operating lamp—is known, which for the purpose of uniform illumination of the operating area, has several light beams emerging from one light source. The light beams are directed at each of two deflection mirrors arranged in a lamp arm. In this way, one part of each light beam is reflected by an inner deflection mirror and the other part is transmitted to an outer deflection mirror. The slope of the deflection mirror is adjustable in relation to the horizontally running axis of the original light beam. Thus, two light beams, which are directed at the area to be illuminated and are convertible, emerge from each lamp arm. However, the possibility of adjustment with regard to an expansion of the illuminated area or an adjustment of the depth of shadow is not provided here.

In addition, from EP 0 299 196 B1, a operation lamp having at least two separate light beams emerging from different areas of the bottom of the lamp housing is known. The optical axes of the light beams are directed onto an operating area in such a way by at least one adjustment component, that the light beams become superimposed while forming an intensified area of illumination. However, in this arrangement, the setting of an intense illumination of depth, as is necessary, for example, for deep operation wounds, can only be achieved by enlarging the separation distance of the operating lamp, where the intensity of the light as well as the angle of incidence of the individual light beams is reduced and thus approach the housing axis when the separation distance is enlarged.

Furthermore, from DE 25 19 426 A1, a lighting device for a hospital is known that has several lamps which are arranged such that their light axes converge at a focal point so that through adjustment using a lamp guide device, the focal point can be shifted within a plane or perpendicular to a plane in the desired manner. This device involves a relatively expensive construction.

SUMMARY OF THE INVENTION

The purpose of the invention presented here is to create a lamp for forming a low-shadow illuminated area, in which light or light beams emerging from the lamp impinge upon the illuminated area at different angles of incidence, so that both an intense wide illumination as well as a low-shadow depth illumination is possible in the illuminated area itself. In particular, the depth of shadow should be adjustable, as can be necessary especially when using a lamp of this type for medical applications for deep wounds.

Furthermore, as compact a shape of the lamp as possible should be obtained. The shape should allow the lamp to be integrated into existing lighting systems, e.g. for the operating room, in a simple way.

This purpose is achieved in that the angle of incidence of the light can be adjusted by changing the distance between at least two reflectors or between one reflector and the source of the light.

In a preferred embodiment form of the lamp, at least two reflectors are arranged so that they can shift in the radial direction on carrier arms that extend radially from the center of the lamp. In this manner, all reflectors always lie on a common circular circumference, and the reflectors can be shifted through manually activated gears or through electric drive motors.

The operating distance between lamp and wound is preferably in the range from 800 to 1200 mm; the optimal working distance is approx. 1000 mm. The optimal shifting path of the reflectors along the carrier axis lies in the range from 100 to 150 mm. It is thus possible in an advantageous manner to obtain an optimal rear illumination of obstructions in the beam path of the individual lamps.

Proving to be especially advantageous is the simple adjustability between the width illumination and the depth illumination. Furthermore, it proves to be advantageous that both discharge lamps and also spiral-wound filament lamps are suitable for use in the lamp according to the invention.

In an additional preferred embodiment of the lamp, two ring-shaped reflectors are provided coaxially to the lamp-longitudinal axis, where an outer ring-reflector surrounds the light source arranged in the longitudinal axis of the lamp, while on the side that faces away from the illuminated area, an inner ring-reflector is provided. The inner ring-reflector is arranged so that it can shift along the longitudinal axis. The inner ring-reflector can be shifted so far that the outer ring-reflector can be shaded by it so that an intense depth illumination is obtained.

The simple constructive design proves to be advantageous.

In a similarly constructed embodiment of the lamp, the light source is arranged so that it can shift along the longitudinal axis.

Because the reflectors are arranged locationally fixed to each other, a relatively simple mechanical design of the lamp results so that in an advantageous way, a low-maintenance operation is obtained along with a cost-effective manufacturing.

Proving to be especially advantageous is the greatly reduced shadow formation in the illuminated area as compared to traditional lamps allowing use as an operation lamp.

The lamp can thus be universally adapted to the respective operation. In the case of small, deep wounds, the surgeon prefers a lot of light from the lamp center. In the case of large-area, flat wounds, a smaller shadow formation results, since obstructions are illuminated from behind by light from the edge. The light incident at a slant angle improves the three-dimensional visibility for the surgeon.

In the following, the object of the invention is explained in greater detail using the FIGS. 1*a*, 1*b*, 2*a*, 2*b*, 2*c*, 3*a*, 3*b* and 3*c*.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1B:
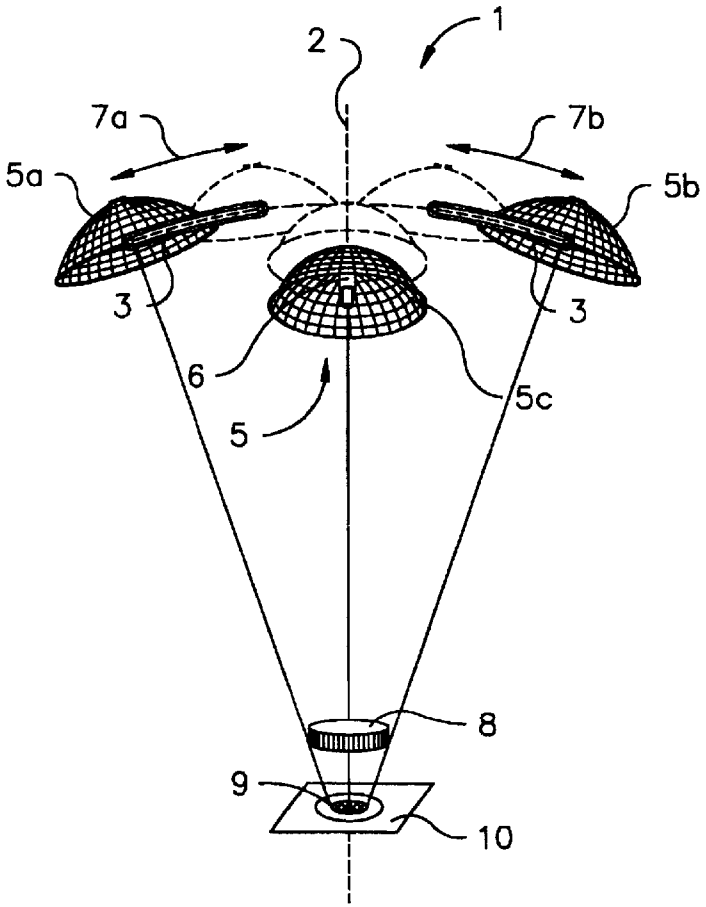
FIGS. 1*a* and 1*b* are views of a lamp having shiftable individual reflectors, where the individual reflectors are arranged so that they can shift, at the respective same distance from a common lamp axis.
Figure 1A:
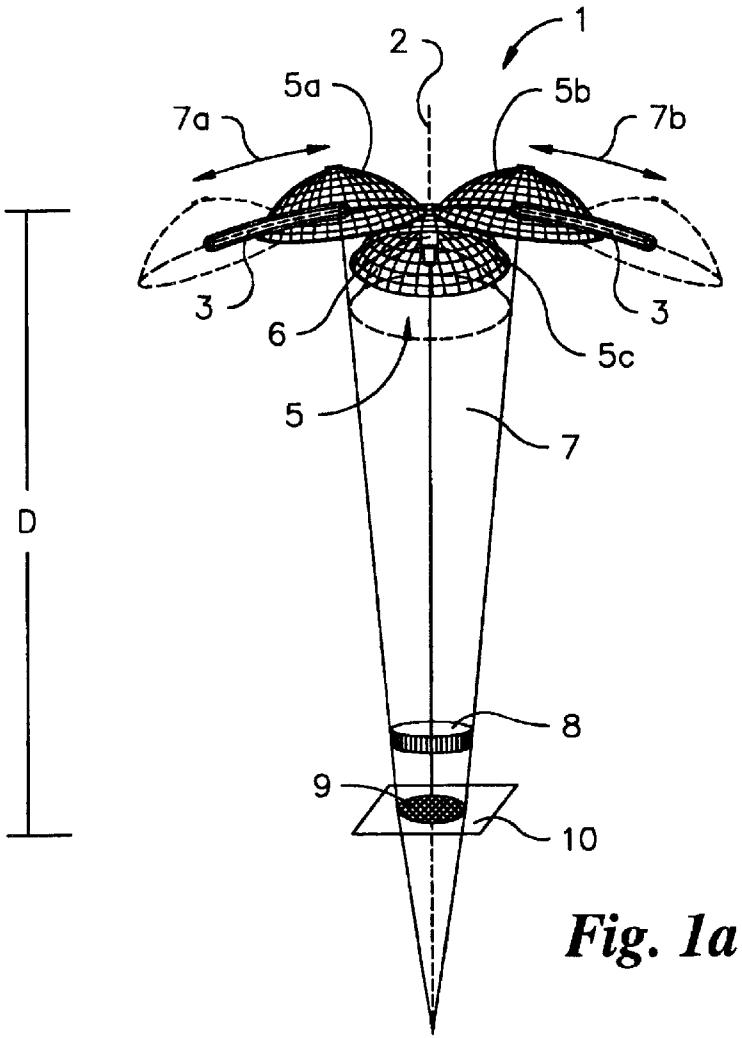

According to FIG. 1*a*, the lamp 1 has several guide rails 3 that are curved in a concave manner and extend radially from their longitudinal axis 2. On them, first, second, and third reflectors 5*a*, 5*b*, 5*c* (collectively, "the individual reflectors 5") with a light source 6 located in at least one of the individual reflectors 5 are arranged so that they can be shifted concentrically. As can be recognized in FIG. 1*a*, the individual reflectors 5 are located in immediate proximity to and positioned on a common circular circumference about the longitudinal axis 2 of the "total system" lamp 1. Accordingly, the light emitted by the source of light illuminates the low-show illuminating area from at least two different angles 7*a*, 7*b* of incidence. Consequently, an object 8 that creates a shadow-such as for example, the surgeon's hands or instruments—throws a relatively large-area shadow 9 in the area of the lighting plane 10. When the object 8 is taken away, a very good depth illumination is obtained because of the almost parallel guidance of the light bundle 7, so that, for example, a deep operation wound would be very easy to see into.

Because of the shift of the individual reflectors 5 concentrically from the longitudinal axis 2 to the periphery of the lamp 1, a relatively large angle of incidence is obtained in the area of the illuminated area 10 according to FIG. 1*b*, so that the object 8 that throws the shadow then only causes a relatively small-area core shadow 9, and thus a relatively large area can be illuminated without a shadow. The individual reflectors 5 are moved either manually via a gear arrangement or by motors via individual drives along the guide rails 3 at a respective distance concentrically to the longitudinal axis 2. The guide rails 3 have a curvature that corresponds in its radius to the distance between the illuminated area 10 and the reflectors 5 of the lamp 1. In this way, the previously adjusted focusing of the lamp is maintained even when the reflectors are shifted. The distance is depicted symbolically here by D.

Figures 2A, 2B, 2C:
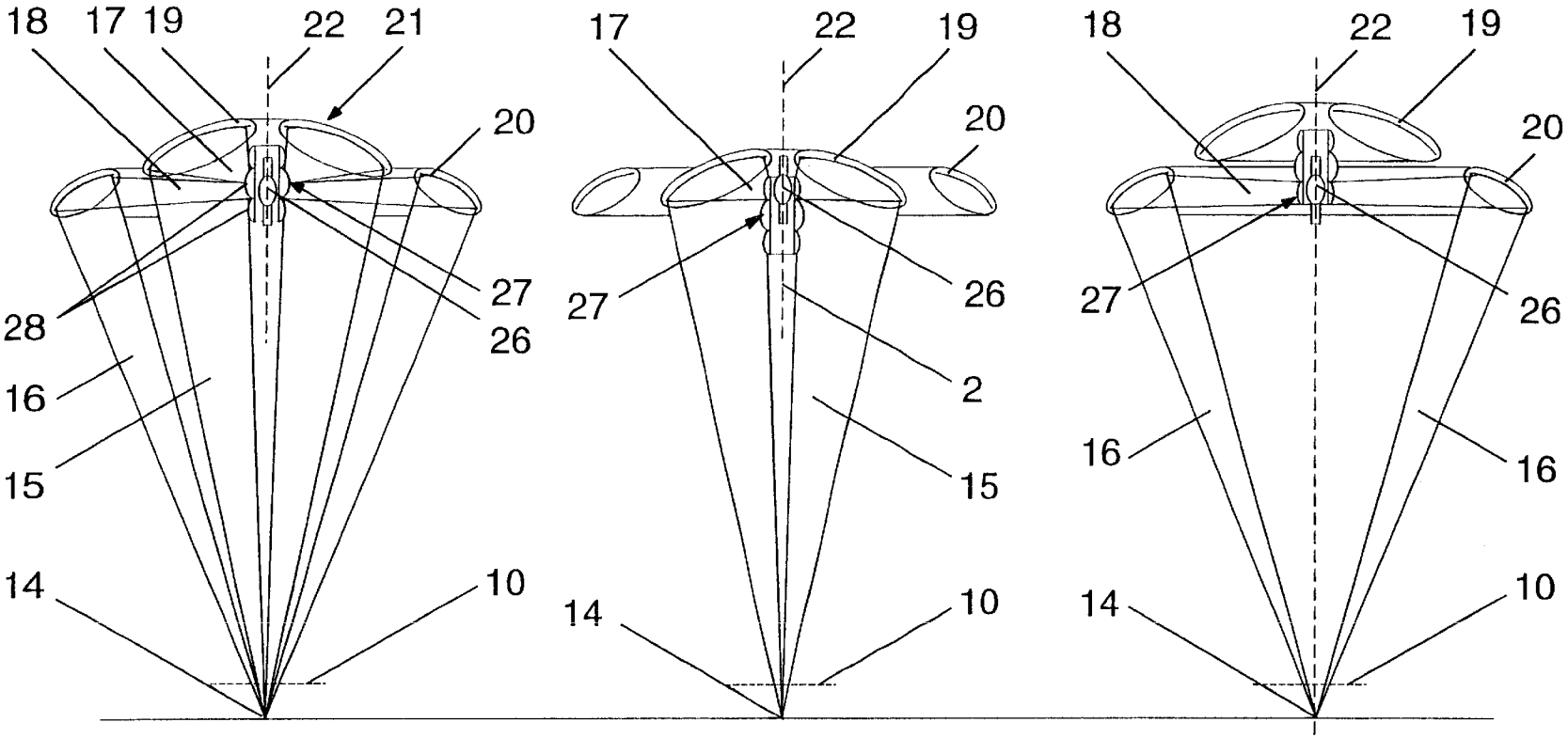
FIGS. 2*a*, 2*b* and 2*c* views of a ring lamp having an adjustable depth of shadow, where an inner reflector is adjustable in such a manner that by changing the distance between a fixed light source and the inner reflector arranged so that it can shift along the axis of the lamp housing, the depth of illumination is adjustable.

FIG. 2*a* shows an embodiment of the lamp in which the light source 26 is arranged along the longitudinal axis 22 of the lamp 21 and is surrounded by an outer reflector ring 20, as seen in the radial direction, which reflects the light generated by the lamp in the direction of the illuminated area 10. In addition, on the side of the light source facing away from the illuminated area 10, an inner reflector ring 19 concentric to the reflector ring 20 is provided which is arranged so that it can be shifted along the longitudinal axis 22 relative to the light source 26 or the outer reflector ring 20. In a preferred embodiment the light source 26 is surrounded by a drum lens system 27 which is arranged so that it can be shifted together with the inner reflector ring 19 along the longitudinal axis 22; the drum lens system 27 consists of three concentric Fresnel lenses 28 (recognizable as focusing lenses in profile) arranged above each other along the longitudinal axis 22. This involves an additional possibility for concentrating the light that emerges from the light source 26, This possibility, however, is not absolutely necessary.

According to FIG. 2*a*, the inner reflector ring 19 is located above the light beam 18 that projects from the light source 26 to the outer reflector ring 20, where the inner reflector ring 19 reflects the light beam 17, emerging from the light source 26, in the direction of the illuminated area 10. The inner light beam is indicated by 15 here, while the light beam reflected from the outer ring reflector to the illuminated area is indicated by 16. It is thus possible according to FIG. 2*a*, to obtain an illumination that is to a great extent free from shadows or low in shadow, so that the head and the hands of the surgeon do not form any disruptive shading when using the operating lamp. If on the other hand, the inner reflector ring 19 is lowered to the extent that it covers the outer reflector ring 20, a pronounced depth illumination according to FIG. 2*b* is obtained that, for example, can be advantageous for operating on deep wounds. Because of the ring structure of the reflector 19, only a slight shading effect is to be reckoned with here when the hands or head of the surgeon come(s) in.

FIG. 2*c* shows, in contrast to FIG. 2*b*, a reflector position, in which the inner reflector ring 19 is shifted to the top out of the beam path of the light source 26, so that only the outer reflector ring 20 is reached by the light beam 18 from the light source 26. Here it can be recognized that a relatively wide-area illumination is possible, while the depth illumination according to FIG. 2*b* no longer plays any particular role. Because of the ring reflector structure, the light beams 16 form a type of double cone structure, where the hollow cones defining the light beams 16 from the inside and outside meet each other in a sort of intersecting point 14.

Figure 3C:
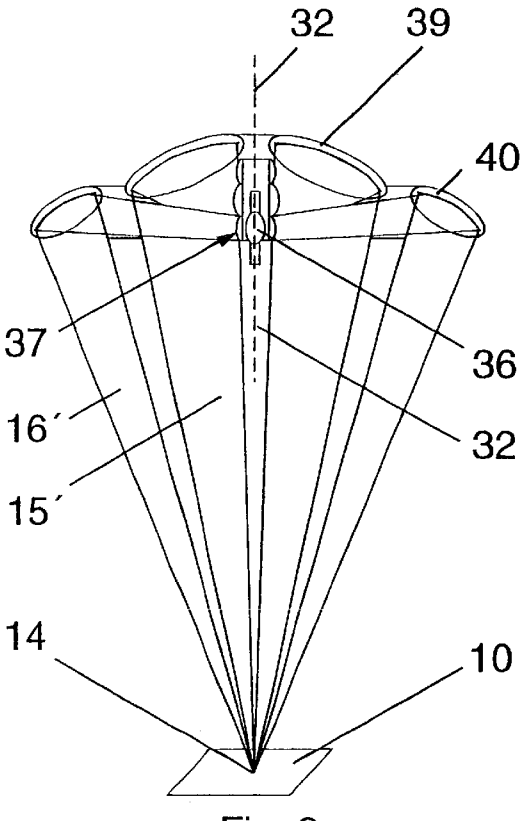
FIGS. 3*a*, 3*b*, 3*c* show views of a similar arrangement as is shown in FIGS. 2*a* to 2*c*, where, however, here the depth of illumination or expansion of the illuminated area is done by changing the distance of the light source relative to the reflector or reflector system.
Figure 3B:
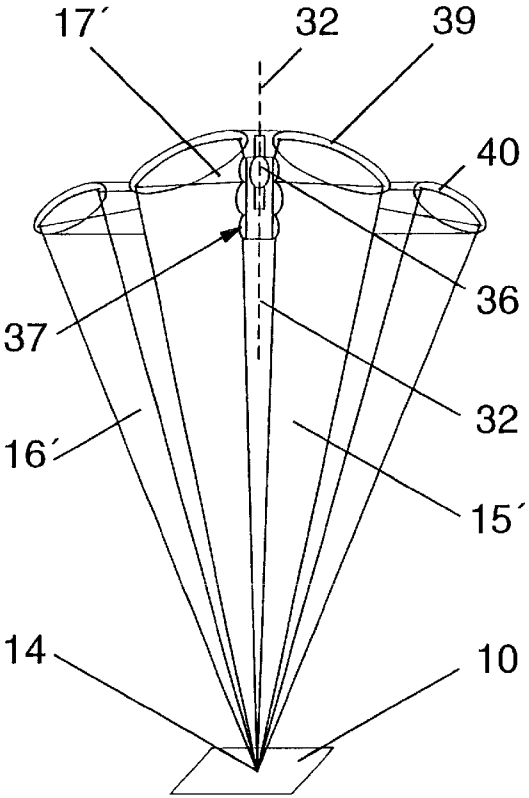
Figure 3A:
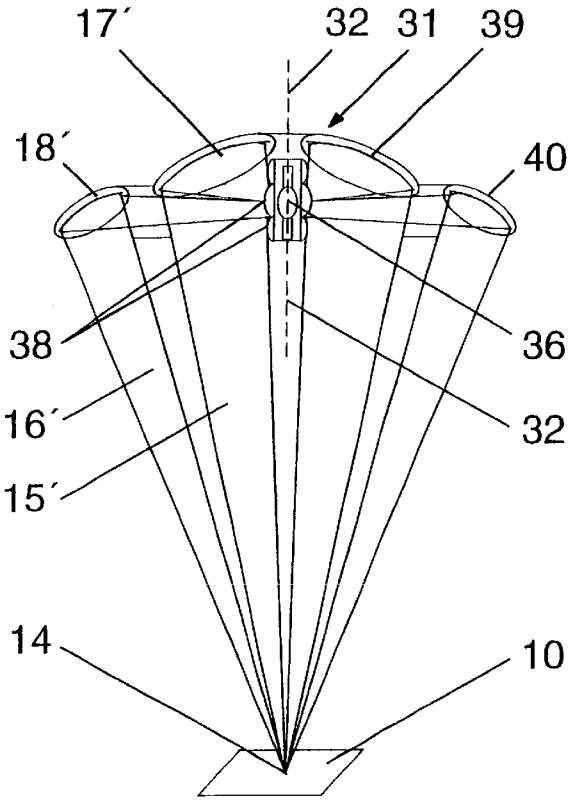

FIG. 3*a* shows a similar structural construction as FIG. 2*a*, where here, however, the two reflector rings that are concentric to each other, 39 (inner reflector ring) and 40 (outer reflector ring), are mounted and affixed, while the light source 36 is movable along the longitudinal axis 32. According to FIG. 3*a*, the light source 36 is located in a middle position (which is comparable to FIG. 2*a*), so that both the outer reflector 40 as well as the inner reflector 39 are supplied with light via the light beams 18', 17'. The beams 15', 16' that go-out in a cone or hollow-cone shape, respectively, approach each other approximately at point 14, so that this point represents at the same time a type of cone point for the hollow cones that form the light beams 15' and 16'. In the lamp position according to FIG. 3*b*, the outer reflector ring 40 undergoes a partial shading and thus only the light directed via the inner reflector 39 is guided to the vertex of the hollow cones that represent the light beams. FIG. 3*c* shows, on the other hand, light source 36 in a lower position, so that mainly the outer reflector ring 40 is impinged by the light and correspondingly the approximate intersection point 14 of the hollow cones is intersected via the light beams 15' and 16'. The illumination plane is also indicated by the number 10 again here.

In a preferred embodiment according to FIGS. 3*a*, 3*b*, 3*c*, the light source 36 is surrounded by a drum lens system 37 that is affixed to the inner reflector ring 39. The drum lens system 37 is made of three concentric Fresnel lenses 38 (recognizable as focusing lenses in profile) that are arranged above each other along the longitudinal axis 32. This involves an additional possibility for concentrating the light that emerges from the light source 36. This possibility, however, is not absolutely necessary.

In the lamps according to FIGS. 2*a*, 2*b*, 2*c* as well as 3*a*, 3*b*, 3*c*, a continuously adjustable intensity distribution or light distribution of the light beams emerging from the inner and outer ring reflectors is thus possible. Thus, for example, 70% of the light from the inner ring reflector and 30% from the outer ring reflector can be emitted for a depth illumination. By moving the inner reflector or the light source, the ratio of the intensity changes continuously above the 50% to 50% condition until the distribution of 30% (inner reflector) to 70% (outer reflector). The condition "all light from the middle" (100%/0%) or "all light from the edge" (0%/100%) is however, not intended to be reached. A multi-level system with the addition of the drum lens system, so that in the respective "shifted state" of the lamp, the reflectors are optimally illuminated, has proven to be especially advantageous. Thus, a counter-reflector for collecting light becomes unnecessary.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

I claim:

1. A lamp, in particular a lamp for medical applications, forming a low-shadow illuminating area, comprising:

at least one source of light; and an arrangement of a first reflector and a second reflector, wherein the first and second reflectors are always positioned on a common circular circumference, the arrangement providing movement of the first and second reflectors in a radial direction on carrier rails having a curvature that corresponds in its radius to the distance between the illuminated area and the first and second reflectors of the lamp, the carrier rails extending radially from a center of the lamp, whereby light emitted by the source of light illuminates the low-shadow illuminating area from at least two different angles of incidence, the at least two different angles of incidence being adjustable by relative movement between the first reflector and one of the second reflector and the source of light.

2. A lamp, in particular a lamp for medical applications, forming a low-shadow illuminating area, comprising:

at least one source of light; and first and second reflectors always positioned on a common circular circumference, the first and second reflectors arranged for movement in a radial direction on carrier rails that extend radially from a center of the lamp, the first and second reflectors movable by one of manually activated gears and electric drive motors, whereby light emitted by the source of light illuminates the low-shadow illuminating area from at least two different angles of incidence, the at least two different angles of incidence being adjustable by relative motion between the first reflector and one of the second reflector and the source of light.

3. A lamp, in particular a lamp for medical applications, forming a low-shadow illuminated area, comprising:

a source of light arranged along a longitudinal axis of the lamp, the source of light being surrounded along the longitudinal axis by a drum lens;

an outer ring-reflector surrounding the source of light, the outer ring-reflector being coaxial to the longitudinal axis; and an inner ring-shaped reflector concentric to the outer ring-reflector, the inner ring-shaped reflector coaxial to the longitudinal axis of the lamp, the inner ring-shaped reflector positioned on a side of the source of light that faces away from the low-shadow illuminated area, and the inner ring-shaped reflector arranged for shifting along the longitudinal axis, whereby light emitted by the source of light illuminates the low-shadow illuminated area from at least two different angles of incidence, the at least two different angles of incidence being adjustable by relative movement between the inner ring-shaped reflector and one of the outer ring-shaped reflector and the source of light.

4. The lamp according to claim 3, wherein the inner ring reflector is arranged so that it can be shifted together with the drum lens.

5. The lamp according to claim 3, wherein the inner ring reflector can be shifted to a point that the outer ring reflector is shaded by it.

6. A lamp, in particular a lamp for medical applications, forming a low-shadow illuminated area, comprising:

a source of light arranged along a longitudinal axis of the lamp, the source of light being surrounded along the longitudinal axis by a drum lens and the source of light arranged for being shifted along the longitudinal axis;

an outer ring-reflector surrounding the source of lights the outer ring-reflector being coaxial to the longitudinal axis;

an inner ring-shaped reflector concentric to the outer ring-shaped reflector, the inner ring-shaped reflector coaxial to the longitudinal axis of the lamp, the inner ring-shaped reflector positioned on a side of the source of light that faces away from the low-shadow illuminated area;

whereby light emitted by the source of light illuminates the low-shadow illuminated area from at least two different angles of incidence, the at least two different angles of incidence being adjustable by relative movement between the inner ring-shaped reflector and one of the outer ring-shaped reflector and the source of light.

* * * * *